United States Patent [19]

Kawaguchi

[11] 4,183,147

[45] Jan. 15, 1980

[54] DEHYDRATION APPARATUS FOR FABRICS

[75] Inventor: Yukiyoshi Kawaguchi, Mukoh, Japan

[73] Assignee: Kabushiki Kaisha San Giken, Kusatsu, Japan

[21] Appl. No.: 869,328

[22] Filed: Jan. 13, 1978

[51] Int. Cl.[2] ..... F26B 5/04

[52] U.S. Cl. ..... 34/16; 34/160; 15/306 A; 15/345

[58] Field of Search ..... 15/306 K, 306 A, 345, 15/346, 307; 134/21, 37; 34/16, 160

[56] References Cited

U.S. PATENT DOCUMENTS

| | | | |
|---|---|---|---|
| 1,375,663 | 4/1921 | Ainsworth | 15/306 A X |
| 2,875,846 | 3/1959 | Yonkers | 15/306 A X |
| 3,037,557 | 6/1962 | Faeber et al. | 15/307 X |
| 3,420,710 | 1/1969 | Wollman | 15/306 A X |
| 3,574,261 | 4/1971 | Bailey et al. | 15/306 A X |
| 3,917,888 | 11/1975 | Beam et al. | 15/306 A X |
| 3,992,746 | 11/1976 | Rhodes | 15/307 |

*Primary Examiner*—Christopher K. Moore
*Attorney, Agent, or Firm*—Price, Heneveld, Huizenga & Cooper

[57] ABSTRACT

A fabric drying method is disclosed in which compressed air or vapor is blown at high or supersonic speed from a slit toward a fabric sheet passing over the curved surface of a back-up roll or bar. By the impact pressure of said high speed air, moisture in the fabric sheet is blown out with a part of said high speed air passing through the fabric sheet and, when necessary, the remaining moisture is suctioned through ports in said back-up roll or bar. Apparatus for dehydrating fabrics, including a compressed air chamber with a slit discharge and a fabric support and back-up roll having a point of tangency with the fabric offset downstream from the slit with respect to the direction of fabric movement is also disclosed. The apparatus has means for exposing the fabric to negative air pressure at a point offset upstream from the slit with respect to the direction of movement of the fabric.

17 Claims, 6 Drawing Figures

DEHYDRATION APPARATUS FOR FABRICS

This invention relates to an improved dehydration method and apparatus for fabrics.

As conventional type dehydration apparatus for removing moisture impregnating in fabrics, there have been such apparatus as a mangle or squeezer or vacuum squeezer. Since fabrics include so many varieties of knitted fabrics, woven fabrics and textile weaves it has been very difficult to remove moisture effectively in every one of these fabrics.

The first object of the present invention is to eliminate defects in the conventional type dehydration apparatus and method and furnish improved apparatus and method able to remove moisture from fabrics without harsh contact of the fabrics by means of resilient members and, without using mechanical pressure. Rather to use only the impact pressure of a high speed air stream upon the fabrics which is able to dehydrate without causing any injury to the fabrics.

The second object of the present invention is to furnish improved dehydration apparatus and method that is applicable to any fabric such as as tufted blankets having piles or giggings and to woven fabrics or to velvets of porous woven fabric and is able to effect complete dehydration for such fabrics without causing any injury to the fabrics.

The third object of the present invention is to furnish dehydration apparatus and method applicable also to knitted fabrics of an expandable nature and porous texture and able to completely dehydrate the same without applying high tension thereto.

The fourth object of the present invention is to furnish dehydration apparatus and method that are able to remove moisture uniformly from a broadcloth without the danger of bending and deflection of squeeze rolls as often seen with the conventional mangles.

The fifth object of the present invention is to furnish improved hydration apparatus the structure of which is simple and easily maintained.

These objects including practice of the improved method can be obtained by the apparatus of the present invention.

In short, the present invention discloses a method by which the fabric is dried by a high speed jet of air applied to the surface of the fabric at a point where the fabric is not normally in contact with a a support surface which jet may cooperate with a negative air pressure applied to the opposite face of the fabric at a point upstream from the jet with respect to the fabric's direction of movement. The invention also includes a back-up roll or bar having a cross section partly arched and disposed perpendicular to the path of fabrics and an air pressure chamber having a long slit extending parallel to said back-up roll or bar for blowing air under pressure. Such slit is so arranged that its center line is nearer to the source of the fabric than to the point where said back-up roll or bar contacts the fabric, that point being in a plane perpendicular to the fabric and extending to the center of said back-up roll or bar.

Other objects and features of the present invention will become apparent as the description proceeds with reference to accompanying drawings in which.

Figure 1:
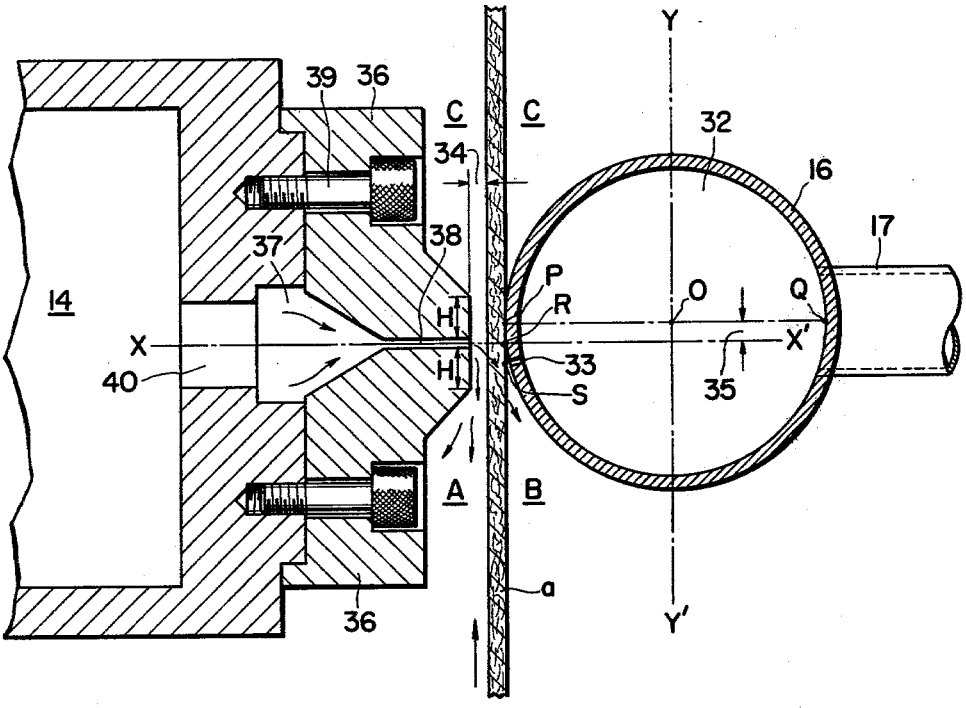
FIG. 1 is a cross section view of essential parts of apparatus made in accordance with the present invention.

Referring now to FIG. 1, in a pressure chamber 14 filled with compressed air or vapor, a number of distributor holes 40 are bored to form a line widthwise of a sheet of fabric. At the front side of the pressure vessel 14, a pair of blocks 36 are secured with bolts 39 and between the blocks a long slit 38 is formed in a widthwise direction of the fabric and at the back of the slit 38 a flow-in chamber 37 is formed which communicates with the distributor holes 40. Control of the width of the slit 38 can be accomplished by tightening of the bolts 39.

Figure 2:
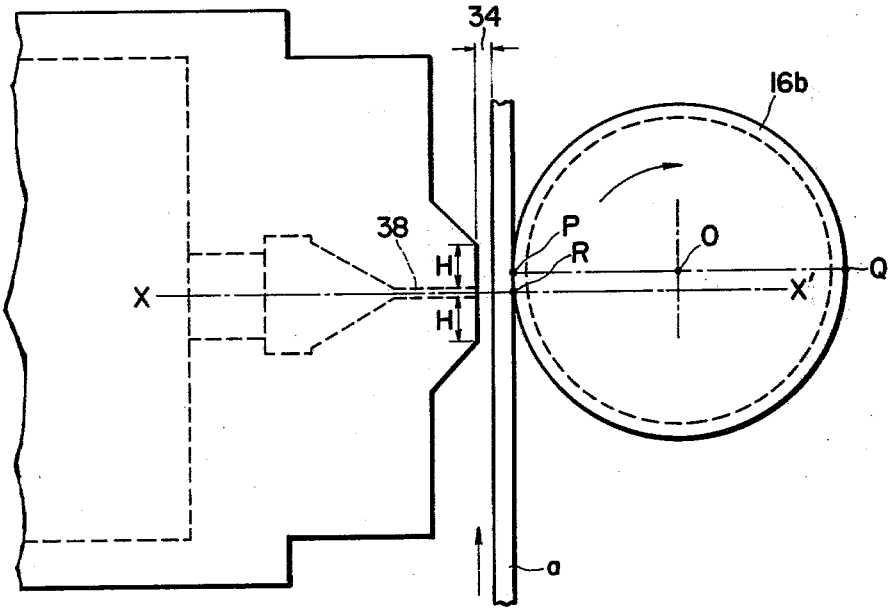
FIG. 2 is a diagrammatically shown front view of the apparatus with a rotatable back-up roll.
Figure 3:
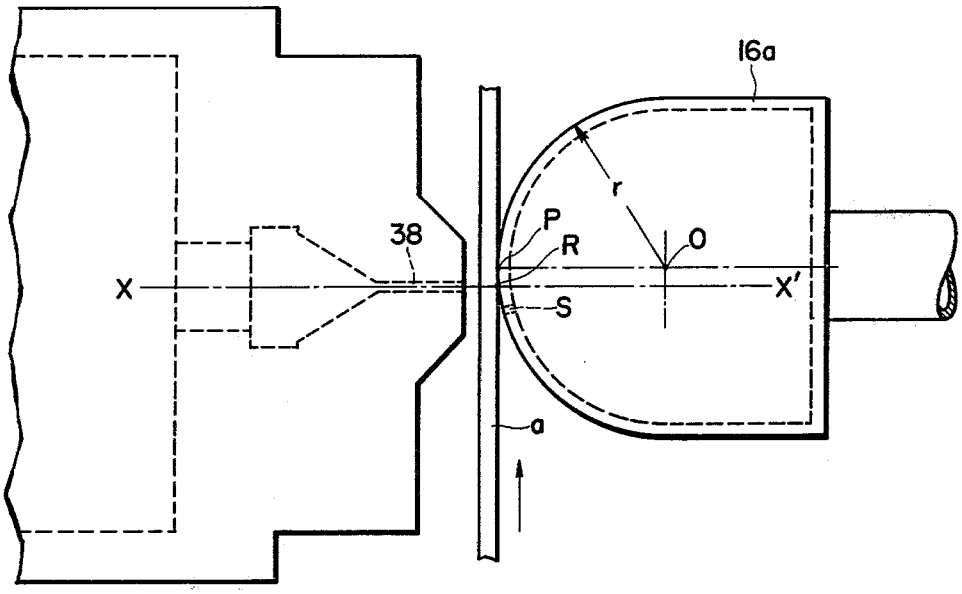
FIG. 3 is a diagrammatically shown front view of the apparatus with a back-up bar.

16 is a back-up element having an arched surface. It is, a hollow cylindrical pipe or bar. In FIG. 2, it is shown as a rotatable back-up roll **16*b*. It is shown in FIG. 3 as a back-up bar 16*a*. The radius r of the arch of the back-up element 16 where it contacts, that is tangent to the fabric a is preferably not more than 70 mm. The back-up element 16 in FIG. 1** is a hollow bar. Now description is made as to this back-up bar.

When the fabric a is dehydrated, the back-up bar together with the fabric is subjected to a heavy pressure by a high speed air stream from the slit 38. Usually a 3-mm gap 34 or less is provided between the opening of the slit 38 and the surface of the fabric.

The center of the radius r of the back-up bar is represented by O and the point p is in a plane passing through O and perpendicular to the fabric.

Next assuming that the center line of the slit 38 is represented by X–X′ and the point of intersection of this X–X′ line with the outer periphery of the back-up bar is represented by R, then in this instance, PO becomes parallel to X–X′ and the distance between these two lines is represented by 35. Since the arch PR is substantially so small that it is approximate to the distance 35. When the distance 35 is established from 1.5 mm through 5 mm, effective dehydration of the fabric can be accomplished. If the distance 35 becomes zero, that is, when PO overlaps X–X′, the dehydration effect is lessened. When the distance PR is set in an appropriate amount, the high speed air stream flows from PO line toward the inlet side A–B of the fabric rather than toward the outlet side C of the fabric, as seen in FIG. 1 because the gap between the slit 38 and the back-up roll 16 is greater in this direction.

In the outer periphery of the hollow back-up bar and at the inlet side of fabric, there are provided a number of suction ports 33. Instead, this may be a slit extending the width of the fabric. With the position of the suction slit represented by S, the distance RS of 1mm–5 mm has proved experimentarily to have the highest dehydration effect for the fabric. The inside of the back-up bar is a pressure reduction chamber 32.

At the front side of the block 36 facing the fabric a and separated by the slit 38 are formed opposed projected portions. The height of this projected portion is represented by H. In this instance, it is preferable that the height of H be 5 mm–10 mm.

When the high speed air stream is blown from the slit 38, it impacts the surface of the fabric and a part thereof is forced in direction A and the other part thereof passes the fabric and flows in direction B. Generally, because of the gap 34 between the slit 38 and fabric, the high speed air stream flows more in the direction A. With this flow, the fabric tends to be attracted momentarily toward the slit 38. However since an air stream of substantial volume is continually blown from the slit 38, the fabric is forced back toward the back-up roll 16. Accordingly high frequency vibrations between the slit and back-up roll are imparted to the fabric. Thus a larger part of the water flows in the direction A with the rebounded high speed air stream and vibrations of the fabric. If the length of said projection H is larger than 10 mm, the high speed air stream would not effectively flow out.

Now the function of the suction ports 33 is as follows. With the high speed of air stream, the fabric a is dehydrated at said point R. However if the texture of fabric is so close or the fabric itself is so thick that the high speed air stream can hardly pass through it, water substance tends to remain in the side facing the back-up bar. In this instance, such water substance can be removed by producing a negative pressure of about 200 mmHg at the ports. Since such negative pressure to effect suction is less than half of that produced by a vacuum squeezer, the fabric is not subjected to a high tension.

As said above, the moisture will be completely removed from any fabric which is closely textured or is a thick sheet with the high speed air stream and suction from the suction ports. Fabrics having porous texture or which are thin will be more easily dehydrated only with the high speed air stream blown from said slit 38.

Figure 4:
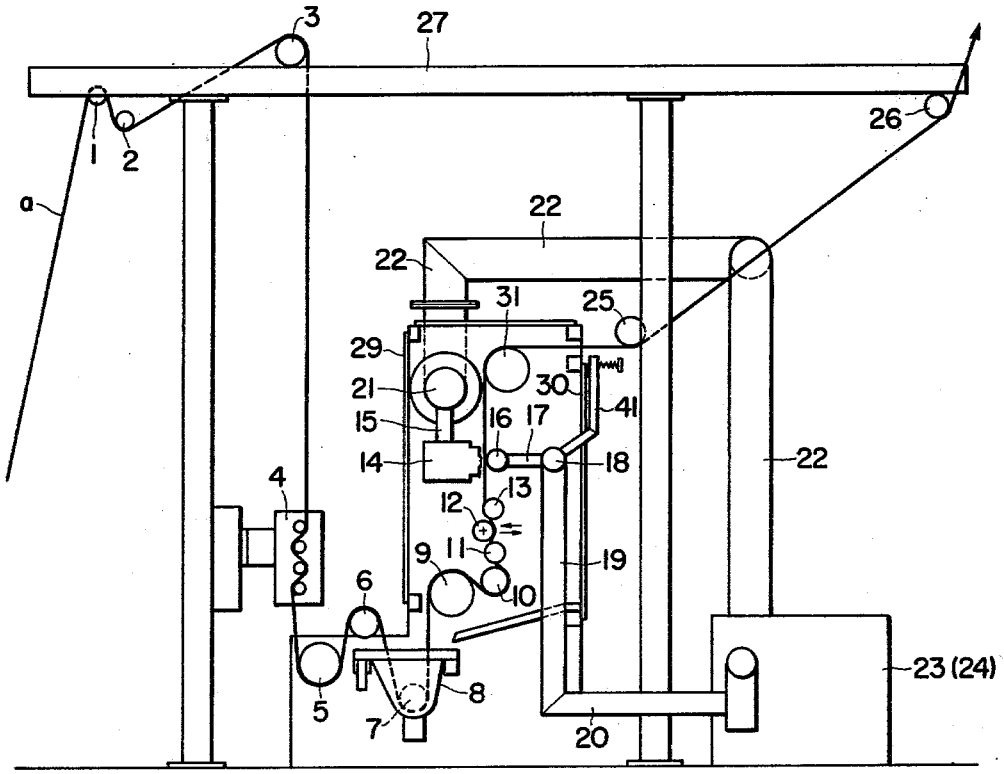
FIG. 4 is a diagrammatic view of the overall system of one embodiment.
Figure 5:
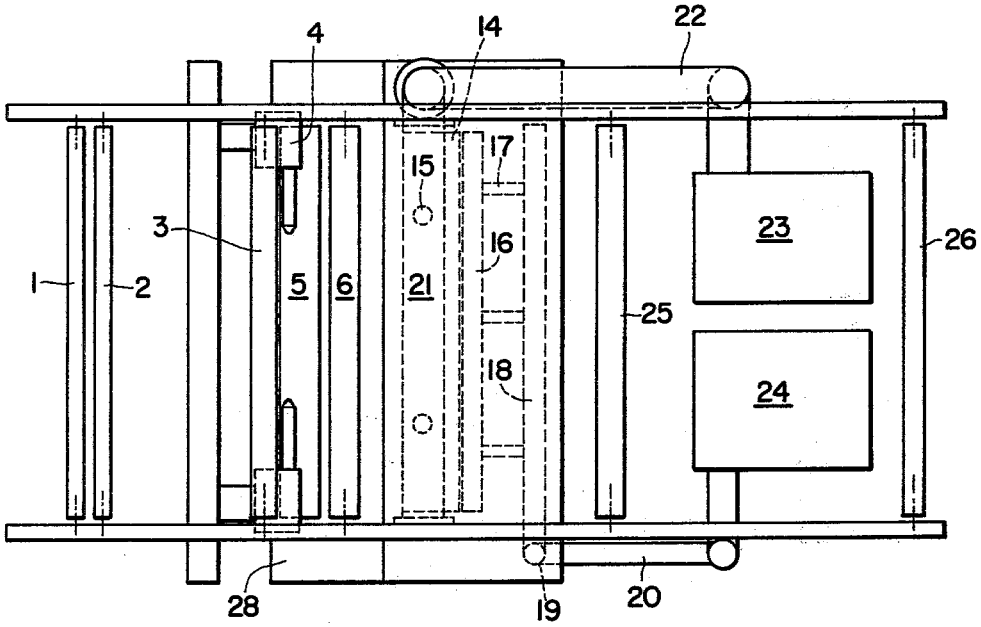
FIG. 5 is a diagrammatic plan view of the system illustrated in FIG. 4.

Apparatus in accordance with the present invention is shown in FIG. 4 and FIG. 5. Fabric a is fed through swivel tension bars 1, 2 and a roll 3 and extended with a cloth guider 4. Then the fabric is sent by a drive roll 5, via an idle roll 6 to a roll 7 in a bath tank 8 and immersed in water or any other liquid. Thus moistured fabric sheet is moved around rolls 9, 10 to screw expanders 11, 13. These screw expanders 11, 13 are rotated by a motor in case of FIG. 4 in counter clockwise direction for stretching the fabric. A press roll 12 is movable in a horizontal direction to control the tension of the fabric sheet around the expanders 11, 13.

High pressure air is supplied by a high pressure blower 23 via an air supply pipe 22 to an air distributor pipe 21 disposed in the direction of the width of fabric and through branch pipes 15 to the pressure chamber 14 and blown as said before toward the surface of the fabric through the slit.

With a suction pump 24, moisture air is suctioned from the back-up bar 16 via branch pipes 17, collector pipe 18, conductor pipe 19 and suction pipe 20.

Figure 6:
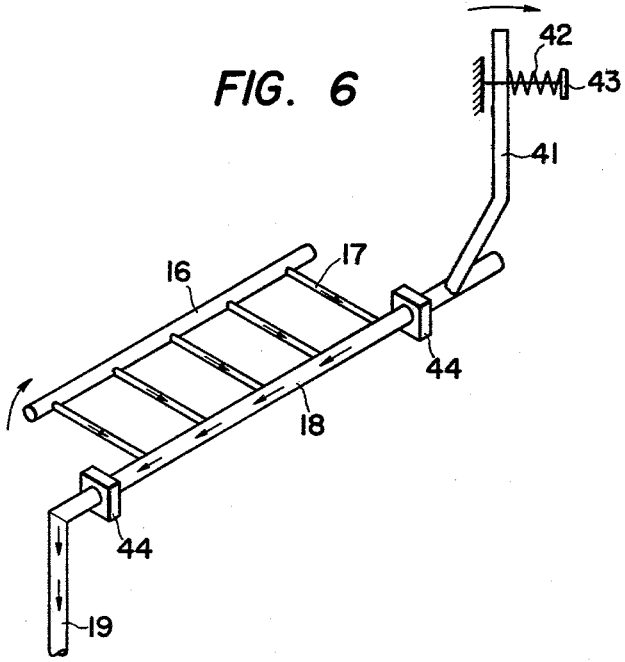
FIG. 6 is a perspective view of the supporting element of a back-up bar.

The collector pipe 18 attached to the back-up roll or bar 16 is journalled in bearings 44 and secured to a lever 41. The other end of the lever 41 is pressed by means of a spring 42. By providing a stop in an appropriate position, the gap 34 in FIG. 1 will be set. If the fabric sheet has seams, the back-up roll is lifted and allows the sheet to easily pass. 43 is a control handle (FIG. 6).

The back-up roll **16*b* in FIG. 2** is rotatable. Its driving means is not shown in the drawings, but it may be easily provided. In this case, it is not associated with a suction pump.

The fabric after the removal of the moisture in the gap between the pressure chamber 14 and back-up bar 16 is sent by an upper driven roll 31 to another plant via rolls 25, 26. Since knitted fabrics which by nature are flexible tend to be stretched too much by the tension imparted during their advance and tend to have curling of their selvage with strong working, for such articles to be moderately stretched by expanders 11, 13, it is necessary to make the circumferential rotary speed of the guide rolls 9, 10 faster than that of the driven roll 31.

In FIG. 4 and FIG. 5, 27 is an apparatus frame, 28 a side box, 29 a front door and 30 is a back door.

It is to be noted that the present invention is not limited to the above. Modifications thereto may be made without departing from the spirit of the present invention.

What is claimed is:

1. Dehydration apparatus for fabrics having means for moving the fabric as a web therethrough, said apparatus comprising: a back-up member for the fabric having a fabric contacting first portion and a second portion extending away and spaced from the fabric; said member disposed perpendicular to the path of the fabric; a chamber for air under pressure having an elongated slit parallel to said back-up member and extending perpendicular to the path of the fabric for discharging the air under pressure and toward said back-up member, the center line of said slit being offset from the fabric contacting portion of said back-up member in the direction from which the fabric enters said apparatus and overlying said second portion of said back-up member.

2. Dehydration apparatus for fabric as described in claim 1 wherein the surface of said back-up member forming said first and second portions is an arcuate surface with said first portion being the point of tangency between said surface and the fabric.

3. Dehydration apparatus for fabric as described in claim 2 wherein said chamber has a pair of air confining surfaces one on each side of said slit and extending parallel to the direction of movement of the fabric; means for passing the fabric between the slit and the back-up member as a flat planar sheet with its contact with the back-up member limited to the point of tangency between the fabric and the back-up member.

4. Dehydration apparatus for fabric as described in claim 1 wherein said chamber has a pair of air confining surfaces one on each side of said slit and extending in the direction of movement of the fabric.

5. Dehydration apparatus for fabric as described in claim 4 wherein the maximum spacing between the fabric and said surfaces is 3 mm.

6. Dehydration apparatus for fabric as described in claim 5 wherein the width of said surfaces in the direction of movement of the web is 5 mm to 10 mm.

7. Dehydration apparatus for fabric as described in claim 6 wherein said air confining surfaces extend parallel to the surface of the fabric.

8. Dehydration apparatus for fabric as described in claim 1 wherein aperture means extending the width of the fabric is provided in said second portion of said back-up member, said aperture means being offset from said slit in the direction from which the fabric enters the apparatus; a source of vacuum connected to said aperture means.

9. Dehydration apparatus for fabric as described in claim 8 wherein said aperture means is a narrow slot.

10. Dehydration apparatus for fabric as described in claim 8 wherein the spacing between the centerline of the slit and the centerline of the aperture means is 1 mm to 5 mm.

11. Dehydration apparatus is described in claim 10 wherein said back-up member is a tube and provides a conduit for the vacuum.

12. Dehydration apparatus for fabric as described in claim 11 wherein said aperture means is a slot; the spacing between the centerline of the slit and the center line of the slot is 1 mm to 5 mm; a pair of air confining surfaces, one on each side of said slit and extending parallel to the direction of movement of the fabric, the width of said surfaces in the direction of movement of the fabric being 5 mm to 10 mm and the maximum spacing between the fabric and said surfaces being approximately 3 mm; the spacing between the conterline of the slit and the point of tangency of the fabric with the first portion of said back-up member is 1.5 mm to 5 mm.

13. Dehydration apparatus for fabric as described in claim 8 wherein means are provided for adjusting the position of said back-up member in response to changes in the thickness of the fabric to maintain a gap of substantially constant size between the slit and the fabric surface.

14. Dehydration apparatus for fabric as described in claim 1 wherein said arcuate surface is a segment of a circle having a maximum radius of 70 mm.

15. The method of drying fabric as a continuously moving web, including the steps of passing said web in tangential contact with an arcuate surface having the cross-sectional shape of a segment of a circle, directing a jet of high pressure air against a surface of the fabric at a first point offset upstream with respect to the fabric's direction of movement from said point of tangential contact, said surface of the fabric facing the jet being the one facing away from said arcuate surface, and applying a vacuum to said fabric on the surface thereof opposite from said jet for withdrawing liquids from the opposite surface of the fabric at at second point closely adjacent to but offset upstream of said first point.

16. The method of drying fabric as described in claim 15 including the steps of confining the air released by the jet to a narrow passage immediately adjacent the surface of the fabric and by the opposing forces of the air jet's impact and the flow of air in the passage imparting high frequency vibrations to the fabric.

17. The method of drying fabric as a continuously moving web, including the steps of passing the web as a planar sheet upwardly past an arcuate surface having the cross-sectional shape of a segment of a circle and maintaining contact with said arcuate surface substantially only at the point of tangency between the web and surface, directing a jet of high pressure air against the surface of the fabric at a point offset upstream from said point of tangential contact with respect to the fabric's direction of movement, said jet being directed against the surface of the fabric facing away from said arcuate surface, confining a substantial portion of the air released by the jet to a narrow passage extending parallel to the fabric and in the direction from which the web approaches the surface for forcing liquid out of the fabric and in the direction of movement of the air in the passage.

* * * * *